US010197292B2

(12) United States Patent
Van Der Sluis et al.

(10) Patent No.: US 10,197,292 B2
(45) Date of Patent: Feb. 5, 2019

(54) BURNER MODULE FOR A COOKER, A COOKER OR HOB AND METHOD FOR MANUFACTURING THEREOF

(75) Inventors: Martin Johan Van Der Sluis, Staphorst (NL); Paulus Johannes Maria van der Kooi, Amersfoort (NL)

(73) Assignee: PCS Holding B.V., Woerden (NL)

( * ) Notice: Subject to any disclaimer, the term of this patent is extended or adjusted under 35 U.S.C. 154(b) by 739 days.

(21) Appl. No.: 13/375,871

(22) PCT Filed: Jun. 9, 2010

(86) PCT No.: PCT/NL2010/050352

§ 371 (c)(1), (2), (4) Date: Mar. 5, 2012

(87) PCT Pub. No.: WO2010/143952

PCT Pub. Date: Dec. 16, 2010

(65) Prior Publication Data

US 2012/0152231 A1 Jun. 21, 2012

(30) Foreign Application Priority Data

Jun. 9, 2009 (EP) ..... 09007591
Jul. 16, 2009 (NL) ..... 2003212

(51) Int. Cl.
*F24C 3/08* (2006.01)
*F24C 15/10* (2006.01)

(52) U.S. Cl.
CPC ..... *F24C 15/107* (2013.01); *F24C 3/085* (2013.01); *Y10T 29/49348* (2015.01); *Y10T 29/49826* (2015.01)

(58) Field of Classification Search
CPC ..... F24C 3/087; F24C 3/082
USPC ..... 126/39 E, 39 N
See application file for complete search history.

(56) References Cited

U.S. PATENT DOCUMENTS 1,367,333 A 2/1921 Truesdell
2,107,972 A * 2/1938 Antrim et al. ..... 126/39 R
2,117,227 A * 5/1938 Stockstrom ..... F24C 3/12 236/15 A (Continued)

FOREIGN PATENT DOCUMENTS

BR 9601448 11/1998
EP 0969253 1/2000

(Continued)

OTHER PUBLICATIONS

Espacenet, Machine Translation of NL1035586, Translated Sep. 4, 2014.*

(Continued)

*Primary Examiner* — Kenneth Rinehart
*Assistant Examiner* — Deepak A Deean
(74) *Attorney, Agent, or Firm* — Marcus C. Dawes; Daniel L. Dawes

(57) ABSTRACT

The present invention relates to a burner module for a cooker and a cooker and a method for such a burner module. The burner module according to the invention comprises: a carrier with which the burner module can be placed as a unit on a worktop; an outlet for gas provided on the carrier; an inlet provided on the carrier for supplying gas; and control means provided between an inlet and the outlet for realizing a gas flame.

22 Claims, 11 Drawing Sheets

(56) References Cited

U.S. PATENT DOCUMENTS

| | | | | | |
|---|---|---|---|---|---|
| 2,654,359 | A | * | 10/1953 | Reeves | F24C 3/106 126/214 C |
| 2,806,464 | A | * | 9/1957 | Williams et al. | 126/39 H |
| 2,887,103 | A | * | 5/1959 | Reeves | 126/214 C |
| 2,896,704 | A | * | 7/1959 | Aleweld | 431/255 |
| 3,822,982 | A | * | 7/1974 | Du Perow | 431/193 |
| 4,078,543 | A | | 3/1978 | Anandasakaran | |
| 4,354,478 | A | * | 10/1982 | Contini | 126/39 E |
| 4,572,154 | A | * | 2/1986 | Schweitzer | 126/39 E |
| 4,608,962 | A | * | 9/1986 | Ng | H05B 3/74 126/211 |
| 4,705,019 | A | * | 11/1987 | Beach et al. | 126/39 E |
| 4,971,024 | A | * | 11/1990 | Albon | F24C 3/085 126/214 A |
| 5,046,477 | A | * | 9/1991 | Bennett et al. | 126/39 B |
| 5,259,361 | A | * | 11/1993 | LeStrat et al. | 126/39 J |
| D345,891 | S | * | 4/1994 | Blanco | D7/402 |
| 5,301,653 | A | * | 4/1994 | Gerdes et al. | 126/39 E |
| 5,313,929 | A | * | 5/1994 | Thurk et al. | 126/39 B |
| 5,323,759 | A | * | 6/1994 | Hammel et al. | 126/39 R |
| 5,405,263 | A | * | 4/1995 | Gerdes et al. | 431/354 |
| 5,568,804 | A | * | 10/1996 | Joseph et al. | 126/39 K |
| 5,628,302 | A | * | 5/1997 | Schatz et al. | 126/39 R |
| 5,640,947 | A | * | 6/1997 | Shute | 126/211 |
| 5,791,336 | A | * | 8/1998 | Helm | 126/39 H |
| 6,807,962 | B2 | * | 10/2004 | Taplan et al. | 126/39 B |
| 2003/0024525 | A1 | * | 2/2003 | Jennings | F23D 14/045 126/39 R |
| 2007/0210069 | A1 | | 9/2007 | Albizuri | |
| 2008/0289617 | A1 | * | 11/2008 | Graham et al. | 126/39 E |
| 2010/0005976 | A1 | * | 1/2010 | Inzaghi | 99/444 |

FOREIGN PATENT DOCUMENTS

| | | | | |
|---|---|---|---|---|
| EP | 2144010 | A2 | 1/2010 | |
| NL | 1035586 | | 12/2009 | |
| WO | 2006006681 | | 1/2006 | |
| WO | 2006006882 | | 1/2006 | |
| WO | EP 2144010 | A2 * | 1/2010 | F24C 3/085 |

OTHER PUBLICATIONS

International Search Report and Written Opinion for PCT/NL2010/050352 dated Oct. 4, 2010.

* cited by examiner

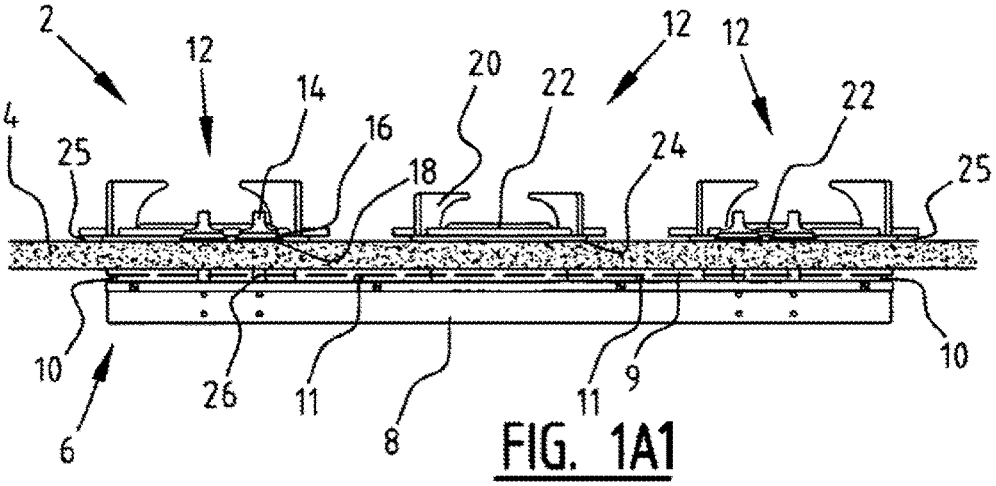
FIG. 1A1
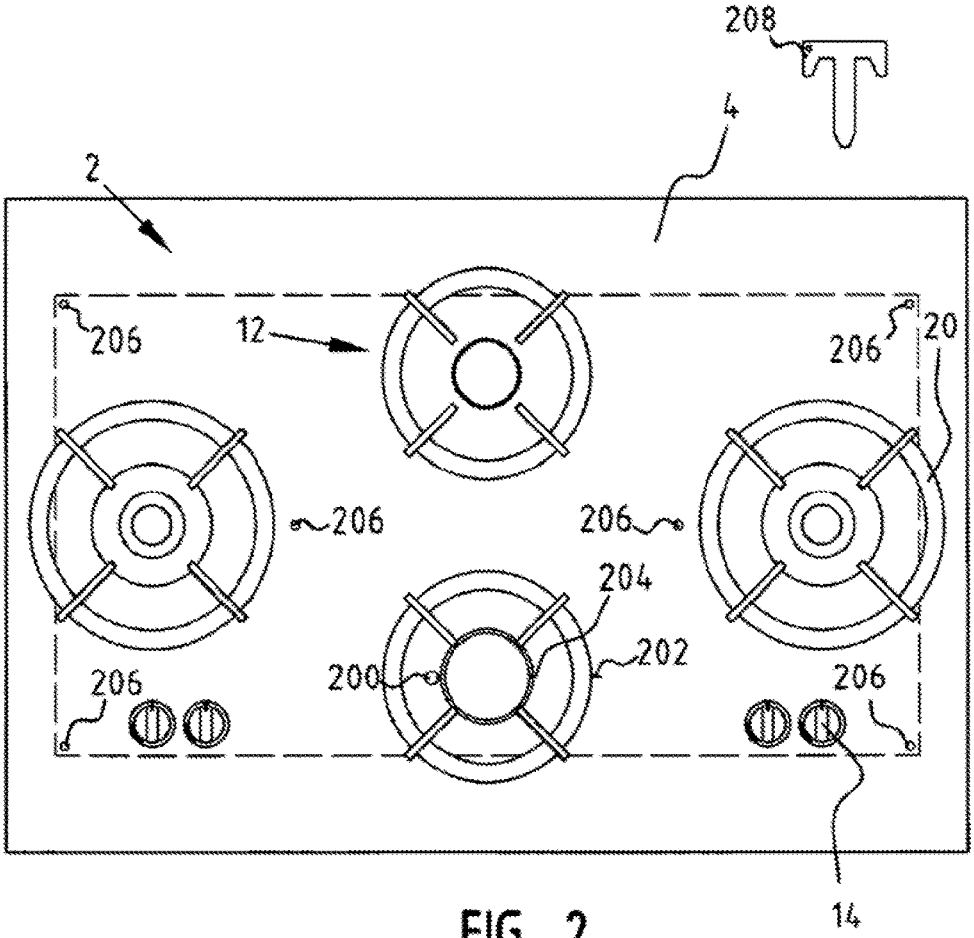
FIG. 2

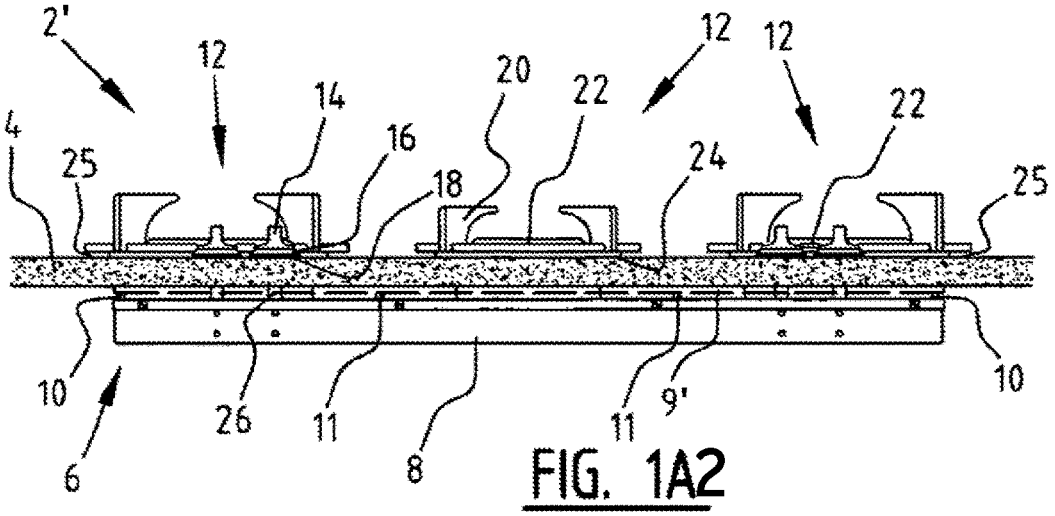
FIG. 1A2
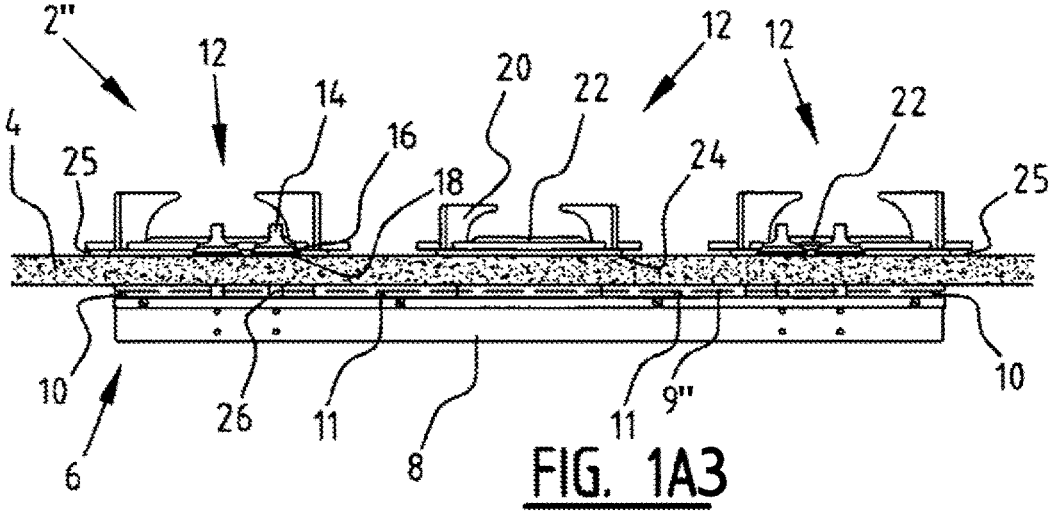
FIG. 1A3

BURNER MODULE FOR A COOKER, A COOKER OR HOB AND METHOD FOR MANUFACTURING THEREOF

The present invention relates to a burner module for a hob or cooker, such as a gas cooker.

Hobs or cookers known in practice usually comprise a worktop in which a large rectangular recess is provided. At the intended position of use of the hob or the cooker a rectangular plate of corresponding dimensions is provided in this recess in which outlets or gas rings are arranged. The required connections are then mounted at this position on the underside of this plate so as to thereby realize a functioning hob or cooker. Diverse operations here have to be carried out at the location of intended use.

The present invention has for its object to provide a burner module for a hob or cooker which can be placed in a more efficient manner.

The object is achieved with the burner module for a hob or cooker according to the present invention, the burner module comprising:

- a carrier with which the burner module can be placed as a unit on a worktop;
- an outlet for gas provided on the carrier;
- an inlet provided on the carrier for supplying gas; and
- control means provided between an inlet and the outlet for realizing a gas flame.

In the context of the present invention a cooker is also understood to mean a hob. Where reference is made to a cooker in the further course of the application, this should also be understood to mean a hob. The outlet or gas ring of the burner module is here supplied from the inlet with a combustible gas, preferably natural gas, which can come from a gas conduit or a gas bottle. The burner module forms a cooker after placing on a worktop. During placing the burner module is preferably arranged on the underside of the worktop, wherein the outlet protrudes through openings provided in the worktop. Using the burner module according to the invention the whole burner module can be placed as unit on a worktop without further fitting operations having to be performed on the different components. The amount of work which has to be carried out at the location of use of such a cooker is hereby limited. This results in a more efficient installation. A further additional advantage lies in the fact that the assembly of the burner module into one unit can be performed in a controlled environment with specialist personnel and tools. In addition to greater efficiency, this also results in greater safety during these operations. In addition, assembly errors are avoided. The prevention of such assembly errors increases efficiency and safety still further.

Worktops can be assembled from for instance stainless steel, glass, concrete, terrazzo, natural stone and diverse types of wood, and of course combinations thereof. An advantage of the burner module according to the present invention is that it can be applied with all these stated types of material on worktops. Other materials are otherwise also possible. In an advantageous preferred embodiment the worktop or countertop are preferably provided on the underside with a heat-conductive element, preferably as a plate-like element. This gives additional support to the worktop, particularly in the case of thinner tops. In addition, the point load from tightening possible fastening elements such as adjusting screws is reduced since it is distributed over the aluminium plate or other heat-conductive element. Because the heat discharge from the worktop is improved, the top becomes less warm and possible damage to the worktop is limited to a minimum, including cracking of possible worktops (granite, concrete etc) owing to the control of peak temperatures. It is additionally also possible to use a different quality of worktop owing to the reduced heat load. The element preferably comprises an aluminium plate. Alternative elements are a mesh or grid, for instance in the form of a honeycomb, preferably also of aluminium. Other heat-conductive materials are also possible.

The burner module according to the invention results in it being possible to realize a cooker wherein the outlets or gas rings are mounted directly onto the worktop. This avoids the necessity for a cooker liner or plate on which these outlets or gas rings are provided. This limits the materials required for a cooker. In addition, a clean design of the cooker is hereby realized, wherein the worktop runs on between the individual outlets or gas rings. An additional advantage here, in addition to the visual aspects, is the reduction in the accumulation of dirt and other materials due to the reduction in the number of edges and joins. This also results in improved possibilities for cleaning such a cooker and keeping it clean.

The burner module comprises a carrier preferably manufactured from a galvanized material. The gas conduits from the inlet to the gas valve and from this valve to the outlet or gas ring are preferably received in such a carrier. The ignition module is preferably likewise accommodated in or on this carrier in the form of a galvanized bottom tray. A gas flame can be realized herewith if desired. On the upper side of the worktop the outlet or gas ring is provided with a preferably enamelled steel cover plate, which is provided on the underside thereof with a rubber ring for sealing between this plate and the worktop. This ring can also serve as spacer for the cover plate and pan support resting on the cover plate, as will be elucidated below. The cover plate is usually provided with a kind of dish shape. On the upper side of the worktop an enamelled steel pan support is further usually provided around the outlet or gas ring for the purpose of thereby positioning a pan for heating relative to the outlet or gas ring. The pan support is preferably provided with a solid ring of increasing diameter which is to be placed substantially horizontally and on which substantially vertical surfaces are preferably arranged as direct support for the pan.

In an advantageous preferred embodiment according to the present invention the burner module comprises adjusting means for connecting the carrier to a worktop.

By providing adjusting means the carrier can be connected to the worktop such that a robust connection is obtained. Through the use of these adjusting means the carrier and the whole burner module connected thereto can be mounted in simple manner on the worktop without further fitting operations being required.

The adjusting means preferably comprise one or more adjusting screws. Alternatively, such adjusting screws can also be embodied in the form of clamping bolts. Through the use of preferably such adjusting screws the placing of the burner module on a worktop is relatively simple and can be performed not only by a professional but, if desired, also by a DIY enthusiast without there being any possible safety hazard. This achieves that more complex assembly operations can be performed in a controlled environment, while the connection of the module to a worktop is relatively simple and can in principle be carried out independently in situ by anyone.

The adjusting means are preferably embodied such that they are suitable for connecting the carrier to the worktop, wherein the worktop can have a thickness in the range of for instance 1 to 50 mm, and preferably 3 to 40 mm. The use of the adjusting means achieves that the burner module can be manufactured independently of the worktop material to be used and also independently of the worktop dimensions used, in particular the thickness thereof. This achieves that the burner module can be manufactured and assembled in a controlled environment without whole or partial disassembly being required in situ by for instance an end user or fitter. A further additional advantage hereof is that a burner module can optionally be reused if the worktop is replaced by for instance another material with different dimensions and/or is provided with additional elements such as a heat-conductive plate.

The burner module is preferably provided on a worktop of the cooker from the underside using the adjusting means. A clean design of the cooker is hereby achieved using the burner module according to the invention.

In an advantageous preferred embodiment according to the present invention the control means comprise a control knob which can be mounted onto or on the worktop, and wherein a sealing ring is provided for sealing and/or positioning the control knob relative to the worktop.

By providing the control means with a control knob a user of the cooker incorporating the burner module according to the present invention can make manual adjustments to for instance the size of the gas flame. The control knob can here be provided on the upper side of the worktop, but also on the side thereof. A sealing ring is provided for the purpose of sealing the control knob relative to the worktop so as to prevent for instance moisture and dirt seeping down from the upper side of the worktop to the underside thereof via the control knob. This sealing ring is preferably glued to the worktop. An additional preferred function of such a sealing ring is to position the control knob correctly relative to the worktop. An additional advantage of using such a sealing ring is that the position of a recess in the worktop for this control knob has relatively large tolerances in respect of position. In a currently preferred embodiment the control knobs are anodized aluminium knobs.

In an advantageous preferred embodiment according to the present invention the control means comprise lengthening means.

By providing lengthening means the control means can be controlled at a greater distance, for instance with a control knob as described above. Such a control is hereby placed at a greater distance relative to the outlet or gas ring of the burner module. Although it is possible per se to provide the lengthening means in the form of a flexible gas conduit or gas tube, it is currently recommended to provide the lengthening means with a flexible control cable such that an operating means can be placed at a flexible distance from the outlet. By providing such a flexible control cable with flexible shaft a control knob can be provided at any desired position in or on the worktop without gas conduits having to be displaced or lengthened. This increases the flexibility in obtaining desired configurations for the cooker provided with a burner module according to the invention. Safety during fitting in situ is further increased since only a position for such a rotary knob or control knob need be provided by the installer or DIY enthusiast. All gas conduits therefore remain intact in the burner module which is assembled in a controlled manner. Using such a control cable the operating means control for instance the gas valve, which is preferably positioned close to the outlet or gas ring.

In a further advantageous preferred embodiment according to the present invention the outlet is provided in a dish, wherein the dish is preferably provided in use with a reverse U-shape.

The outlet or gas ring can be placed on or in the worktop by providing a dish or cover plate. Such a cover plate is usually provided in the form of a dish, wherein the centre of such a dish is at a lower position than the edge thereof. By providing the dish form in the shape of a reverse U the centre of such a dish will however come to lie higher than the edge. Experiments have shown that the heat discharge from such a dish or cover plate is hereby increased such that the temperature of the worktop remains lower during use. This increases the options for the types of material to be used for the worktop.

Spacer means are preferably provided between the dish and the worktop in order to prevent undesirable heat transfer to the worktop. Such spacer means are preferably formed by providing a sealing ring. This achieves that the dishes are positioned higher above the worktop, so that the burner and the pan support are also in a higher position. The pan support as it were "floats" above the tabletop and direct contact heat is avoided. This reduces the heat load on the worktop. The ring has an additional sealing effect in preventing dirt and moisture displacing to the underside of the worktop. This, optionally together with the form of the dish used, also increases the options for employing for instance smaller thicknesses for the worktop, since less heat need be discharged via the worktop. The ring is preferably a silicone sealing ring. This has the additional advantage that no special mastic need be applied during assembly, so that assembly can be carried out more easily and tidily. Dishes are preferably provided from deep-drawn or pressed materials of for instance stainless steel which is optionally brushed, polished and/or glass-pearled, or steel which is optionally galvanized and/or enamelled. As alternative to pressing together or tightening, the dishes can be welded or glued to the worktop.

In a further advantageous preferred embodiment according to the present invention the outlet is provided with a pan support, wherein the pan support is provided with a periphery with an increasing thickness from the centre of the pan support toward the periphery.

The heat transfer from the pan support to the immediate vicinity can be better controlled by providing this pan support, which is provided with an outer ring located on or in the worktop, with a varying thickness of such a ring. It has been found experimentally here that providing a carrier ring, wherein the thickness increases outward as seen from the centre at the position of the outlet or gas ring realizes a better heat transfer. Experiments performed have shown that this difference can increase by as much as 11° C. relative to conventional pan supports. Owing to this improved heat transfer other materials can be used for the worktop and/or other dimensions can be utilized for such a worktop, such as a smaller thickness.

In a further aspect the invention provides an assembly of a worktop or countertop provided with an upper surface and a substructure unit with a number of cooking devices, wherein the cooking devices each extend from a shared substructure support through their own through-hole in the worktop and comprise a heat or leakage plate of their own. Each cooking device can comprise a gas burner, wherein the heat plate encloses the burner laterally.

In a further aspect the invention provides an assembly of a worktop or countertop provided with an upper surface and at least one cooking device, which cooking device comprises a gas burner with burner body and a heat plate enclosing the gas burner, wherein the assembly also comprises a substructure unit with a burner body for the gas burners, and a support for the burner body, wherein the countertop is provided for the purpose of the burner body with a primary through-hole of its own, wherein the substructure unit is placed on the underside of the worktop and extends with each burner body from below from the support through the associated hole, wherein the heat plate extends in radially outward direction to a position over the upper surface of the worktop, wherein the heat plate is fixed—directly or indirectly —to the substructure unit and the substructure unit is provided with adjustable support means for the support, the support means engaging on a bottom surface of the worktop in order to tighten the heat plate against the upper surface of the worktop. The heat plate is preferably mounted on the burner body.

The invention further relates to a cooker and/or worktop and/or kitchen provided therewith, provided with at least one burner module as described above.

Such a cooker and/or worktop and/or kitchen provides the same effects and advantages as those stated in respect of the burner module.

A cooker according to the invention comprises at least one gas burner with burner body and a heat plate enclosing the gas burner, wherein the cooker also comprises a substructure unit with at least one burner body for the at least one gas burner, and a support for the burner body, wherein the worktop or countertop is provided for each burner body individually with a primary through-hole, wherein the substructure unit is placed on the underside of the worktop or countertop and extends with each burner body from below from the support through the associated hole.

Use is preferably made of more than one gas burner per cooker or system in order to enable modular placing of such a set of gas burners in a single operation.

Such an assembly is easy to arrange. A plurality of cooking devices can be installed simultaneously in one operation. The amount of material to be removed from the worktop can remain limited. The upper surface of the worktop can be left largely undisturbed. This avoids damage to the upper surface of the worktop. The cooking devices are better integrated into the surrounding space. Owing to the solitary arrangement of the cooking devices with heat plates of their own, less material is also required for the heat plate, normally the hob of stainless steel. The burner body parts (also referred to as the burner caps or crowns or flame distributors) and burner covers of the burners can extend above the worktop from the heat plate after placing on the burner bodies (also referred to as burner base, into which the gas conduit debouches and mixing with combustion air takes place). The support, which can be plate-like, in particular tray-like, preferably box-like, can be manufactured from inexpensive material since it can remain out of sight.

The heat plates preferably extend in radially outward direction to a position over the upper surface of the worktop, whereby they also cover the through-holes and cleaning of the worktop is facilitated.

The heat plates can be fixed—directly or indirectly—to the substructure unit, and the substructure unit can be provided with adjustable support means for the support, the support means engaging on a bottom surface of the worktop in order to tighten the heat plates against the upper surface of the worktop. The through-holes can then be sealed against dirt and moisture so that they cannot enter this space and the components located therein and thereunder.

In an embodiment the support or lower tray or carrier can be releasable in respect of repair or replacement of components. This avoids damage to the upper surface of the worktop.

In an embodiment the heat plates form part of their own housings for the associated burner bodies, the housings extending upward from the support and being mounted thereon.

In a simple further embodiment hereof the heat plates are mounted—preferably removably—on the rest of the associated housings.

In an alternative further embodiment hereof the heat plates are mounted releasably on the associated burners, in particular on the burner bodies.

In a further development of the assembly according to the invention the support is also provided with a number of holders for a number of operating elements for the associated cooking devices, wherein the worktop is provided with one or more secondary through-holes for the holders, wherein a secondary through-hole is preferably provided in the worktop for each holder for an operating element. Here too the amount of worktop material to be removed is limited, while convenient installation is provided. In an embodiment the secondary through-holes are vertical.

In an embodiment the support forms a box which accommodates the carrier(s) for the burner(s) and burner bodies/burner interior(s) and gas conduit(s) therefor. The box walls shield these components so that they cannot be damaged prior to and during installation and are not directly accessible for intervention by persons lacking expertise. The box can have an upper wall to which the above stated housings are attached so that they protrude upward and thereby form a substructure unit which can be easily handled as a single unit.

In an embodiment of the assembly according to the invention a pan support for a cooking device can support at least partially on the upper surface of the worktop.

The heat plates can form a support for burner flame distributors releasable therefrom without tools.

The heat plates can form a support for pan supports.

The edge of the heat plates can form a centering means for the pan supports.

According to the invention diverse modules can be connected, such as gas rings, although the use of an iron plate for frying in teppanyaki style and/or grilling on a grill plate are also possible.

The invention also relates to a method for manufacturing a cooker or hob, comprising the steps of:

providing a worktop;

providing one or more recesses in the worktop;

placing in or close to the one or more recesses a preassembled burner module as described above; and connecting a burner module.

Such a method provides the same effects and advantages as those stated in respect of the burner module. The present method is particularly advantageous since it achieves that the in situ fitting or assembly operations are greatly reduced and simplified such that a DIY enthusiast can also perform these operations in an efficient and safe manner.

The invention provides a simple method for layout of the kitchen, wherein a kitchen worktop is provided with a through-hole for each cooking location to be realized, wherein a substructure unit with a support for at least the burner bodies of a number of cooking devices for the associated cooking locations is lifted from the underside of the worktop while having the associated burner body extend through a hole of its own to a working position, after which the support is fixed in position.

A heat or leakage plate is then preferably placed from above onto the worktop and fixed to the substructure unit so as to support against the upper surface of the worktop, wherein the substructure unit is as it were suspended from the worktop via the heat plates, after which the substructure unit is tightened downward against a bottom surface of the worktop. The heat plate here forms an aid during installation and a fixing means for the substructure unit after completion of the installation.

Further advantages, features and details of the invention are elucidated on the basis of preferred embodiments thereof, wherein reference is made to the accompanying drawings, in which:

FIGS. 1A1-1C show side views of burner modules according to the invention;

FIG. 2 is a top view of a cooker with burner module according to FIG. 1;

Figure 5A:
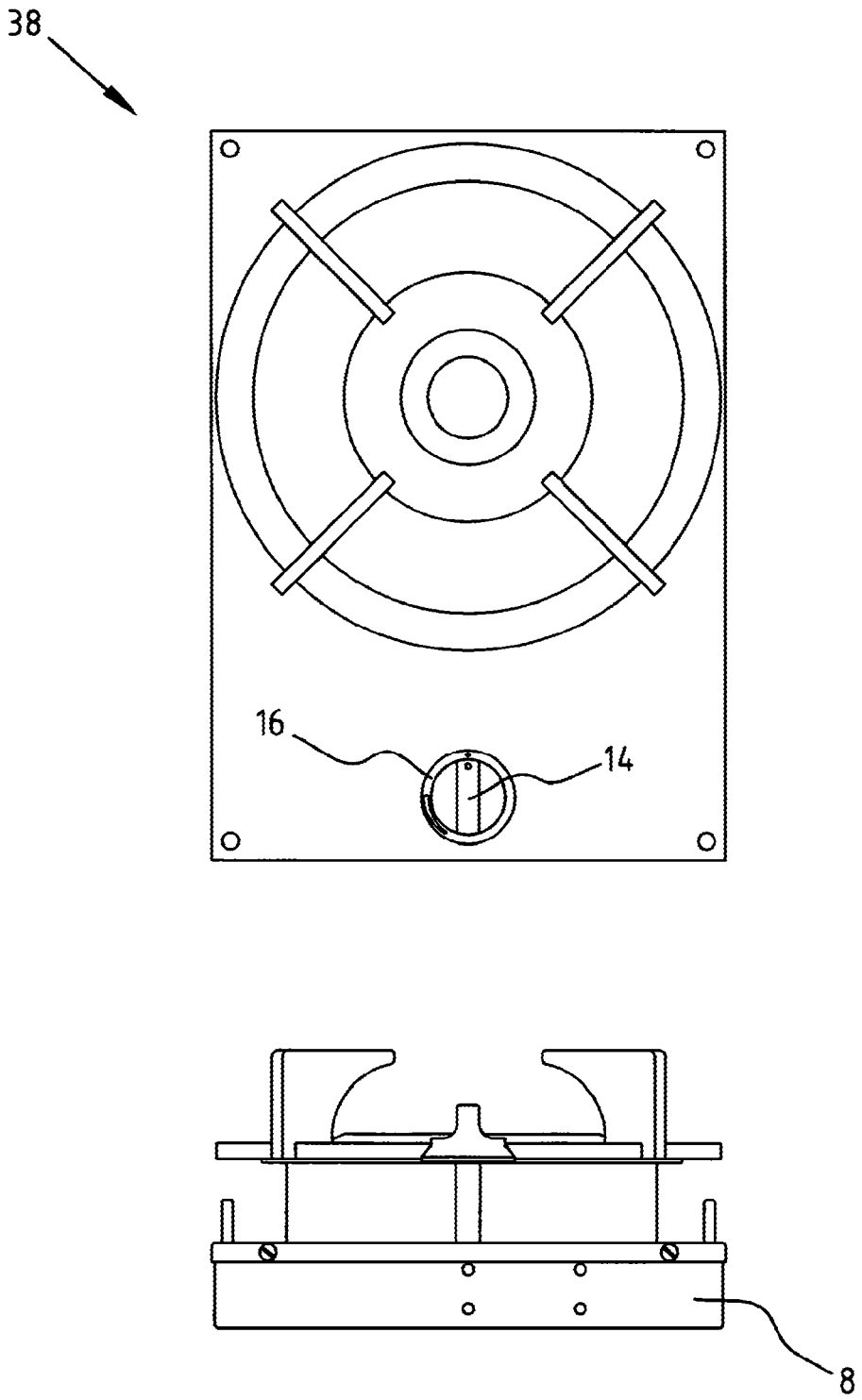
Figure 6:
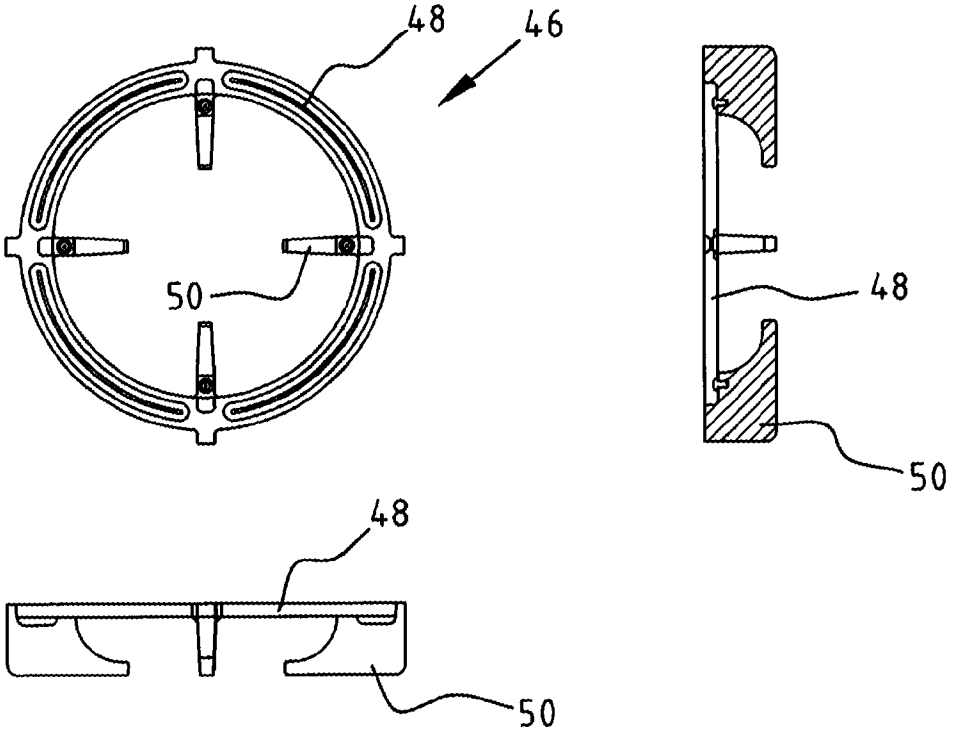
Figure 7:
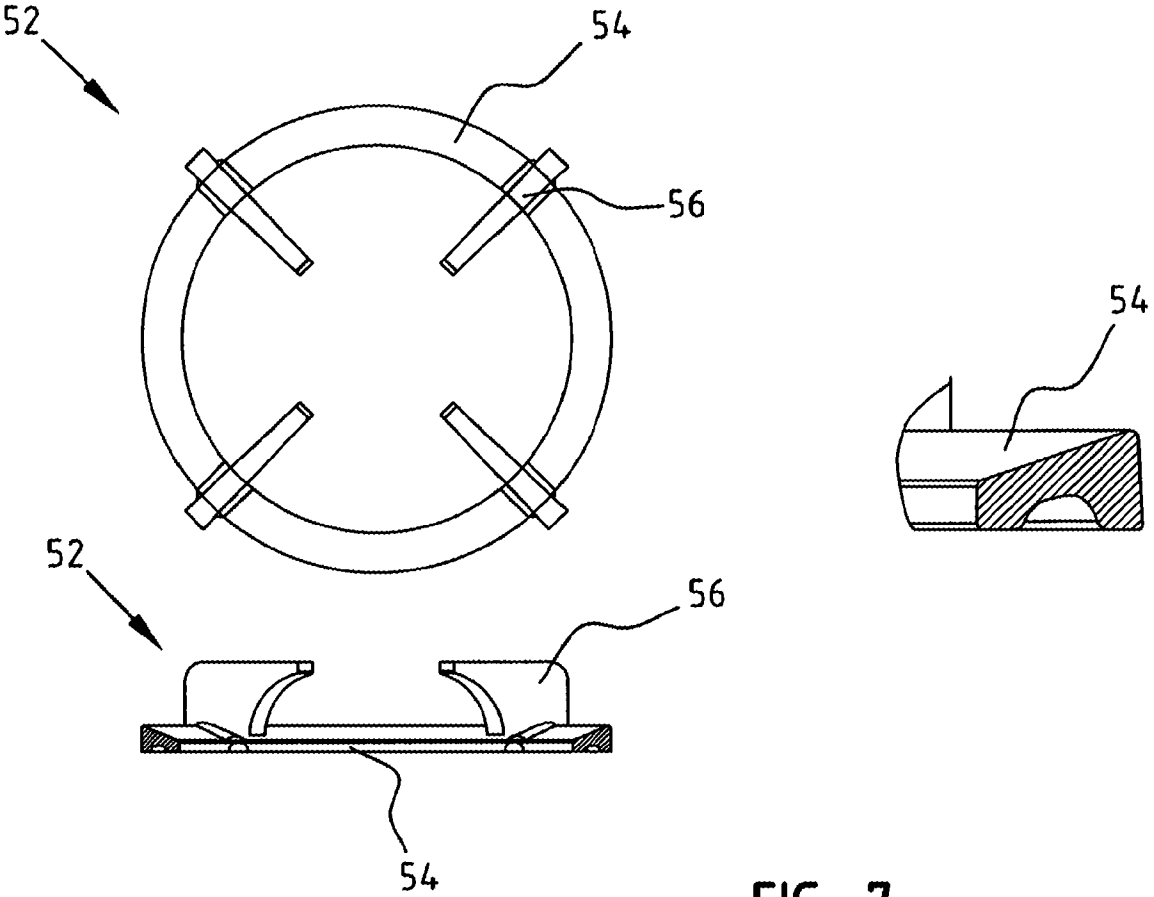
Figure 8:
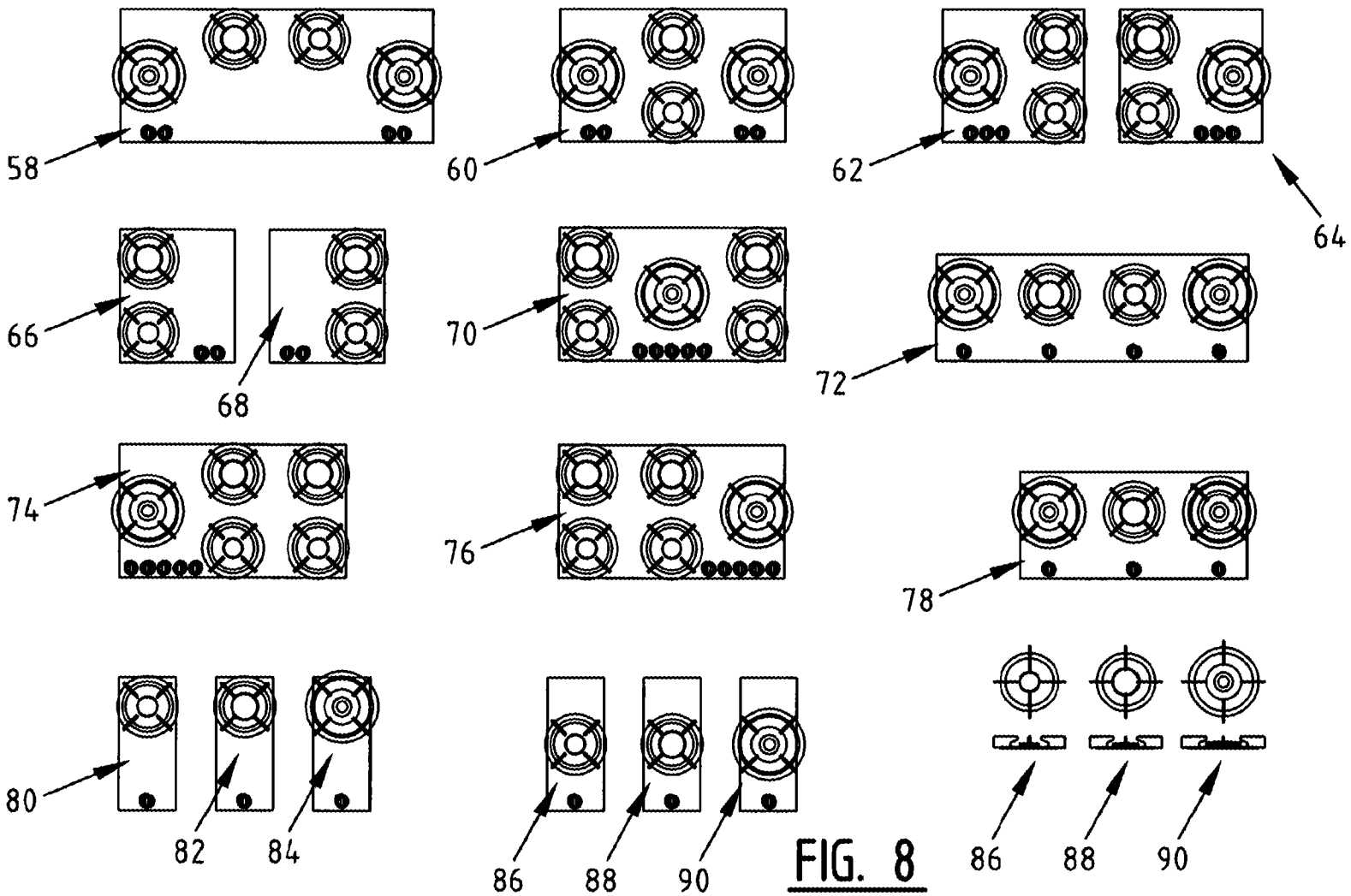
Figure 9:
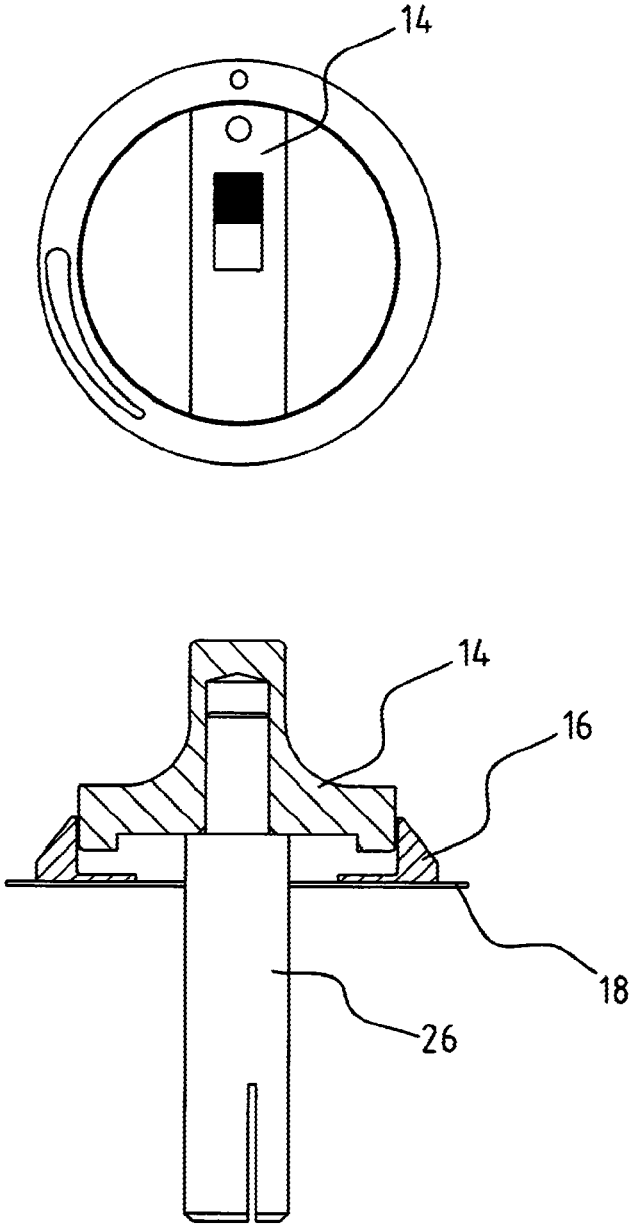
Figure 10:
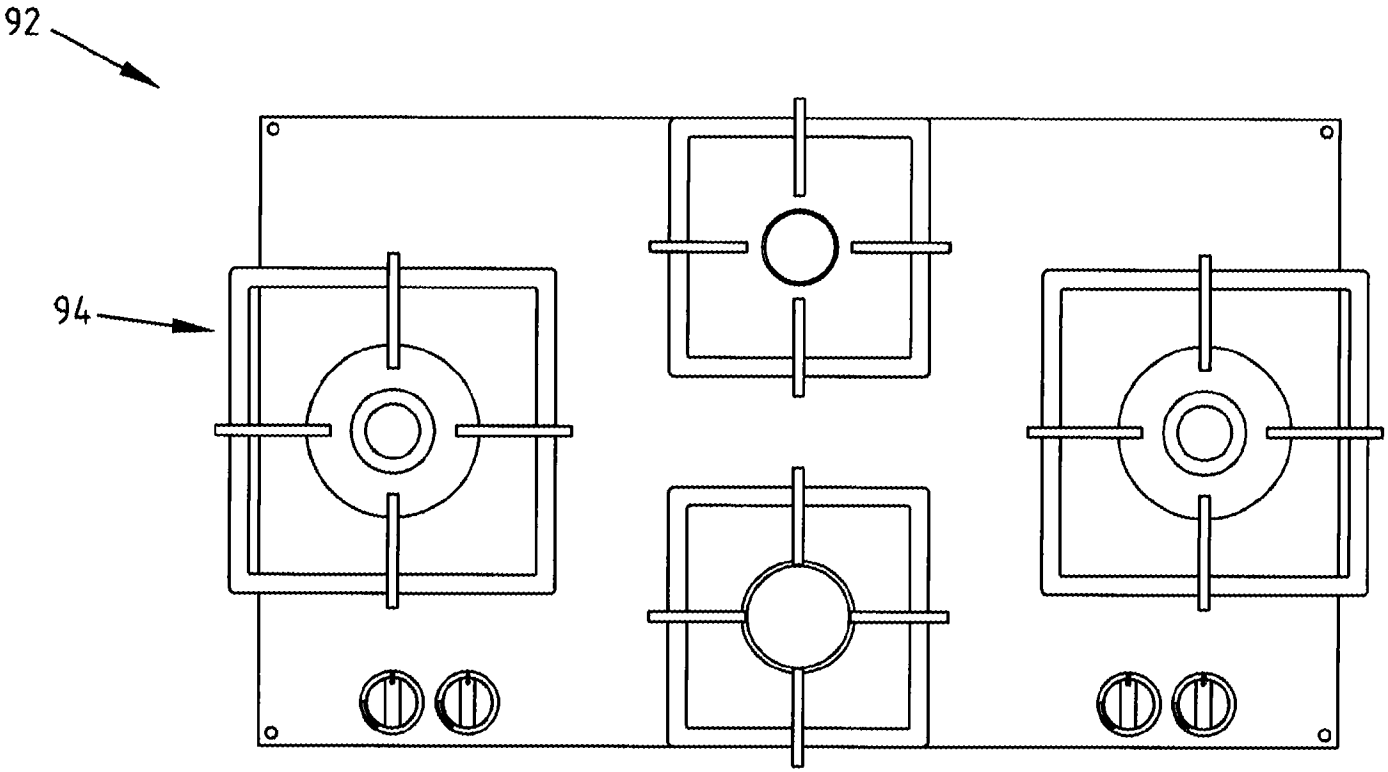

FIGS. 5A and B show views of a burner module with respectively fixed and flexible operating means;

FIG. 6 shows a view of a pan support;

FIG. 7 shows a view of a pan support according to the invention;

FIG. 8 is a top view of possible configurations of burner modules in a cooker;

FIG. 9 shows a detail of the control knob according to the invention;

FIG. 10 shows views of an alternative rectangular embodiment.

Figure 3:
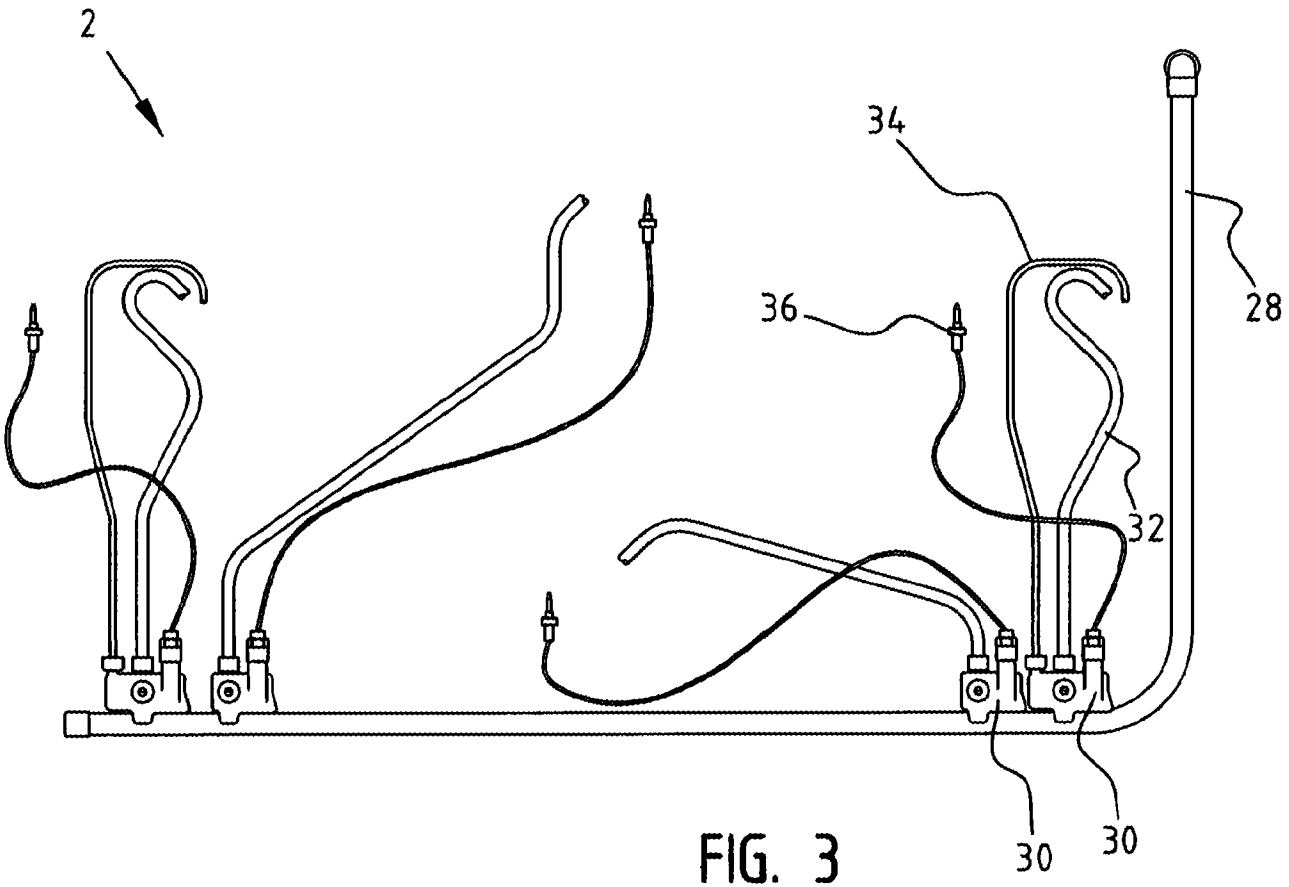
FIG. 3 is a bottom view of a system of FIG. 2.

A cooker system 2 (FIG. 1A1) comprises a worktop 4 provided with a burner module 6. A galvanized lower tray or carrier 8 is provided under worktop 4. Carrier 8 is placed with adjusting screws 10 against worktop 4. In the shown embodiment worktop 4 has a thickness of about 30 mm. The space between carrier 8 and worktop 4 depends on the thickness of worktop 4 and the length of adjusting screw 10. Provided in this space in the shown embodiment is an aluminium heat-conductive plate 9 about 5 mm thick which is placed with adjusting screws 11 against the underside of worktop 4. In an alternate embodiment cooker system 2', and as shown in FIG. 1A2, plate 9 may instead be a mesh 9'. In another alternate embodiment cooker system 2", and as shown in FIG. 1A3, plate 9 may instead be a grid 9". Outlets or gas rings 12 are provided on worktop 4 and are operated using anodized aluminium control knobs 14. In the shown embodiment control knobs 14 are provided on the upper side of worktop 4 and placed inside a rosette 16 mounted on worktop 4 using double-sided tape 18. Other mounting methods are also possible. Gas ring 12 is combined with an enamelled steel pan support 20 which is positioned around an enamelled steel cover plate 22 provided on the underside with a rubber sealing ring 24. Ring 24 creates a distance 25 between plate 22 and worktop 4. This prevents undesirable heat transfer to worktop 4 and imparts height to the pan support. In the shown embodiment cover plate 22 is provided in a kind of reverse U-shape wherein the centre of cover plate 22 is at a higher position than the edge of cover plate 22. A more conventional positioning of cover plate 22, wherein the centre of cover plate 22 is at a lower position than the edge of cover plate 22, is also possible in cooker system 2 according to the invention.

Diverse alternative embodiments of system 2 are possible. The substructure unit 101 (FIG. 1B) thus comprises a box 102 with a bottom plate 105 and a top plate 103. Made in top plate 103 are round holes, at the edge of which cylindrical bushes 106*a-e* are fixed to top plate 103. Extending inside bushes 106*a-e* are burner bodies 108*a-e* which are dish-shaped and provided in the peripheral walls 161*a-e* with igniters 180*a-e* and with bolt holes. Peripheral conduit and fitting spaces 109*a-e* are left clear between the walls 112*a-e* of bushes 106*a-e* and the burner bodies 108*a-e*.

Substructure unit 101 is supplied from below in direction A to a worktop 120, wherein bushes 106*a-e* are inserted from below into holes 121 of their own intended for this purpose, just as in the embodiment discussed in the foregoing, wherein walls 112 extend with some clearance in holes 121. FIG. 1C once again shows only a part of substructure unit 101, wherein the indices "a" are omitted for illustrative reasons.

As soon as the substructure unit has been brought to roughly the correct height, a temporary support is arranged therefor. This can for instance be several rods supporting on the ground. The fitter then places heat plate 111 over hole 121. He then inserts bolts into holes 160 in heat plate 111 and the bolt holes 162 on peripheral wall 161 and thereby tightens heat plate 111 onto burner body 144. Substructure unit 101 is then as it were suspended from heat plate 111 which supports on worktop 120.

Utilized for the purpose of fixing substructure unit 101 to worktop 120 are adjusting bolts 170, the heads 173 of which are accessible from below by a tool through a hole intended for this purpose in bottom plate 105. Adjusting bolts 170 are screwed into nuts 171 attached to top plate 103 and extend through a suitable hole in this top plate 103 and the end 172 thereof comes up against the lower surface 125, preferably with plate 9 therebetween, of worktop 120 after rotation of adjusting bolt 170 in direction B. Further rotation of adjusting bolts 170 urges the substructure unit 101 downward in direction C, wherein heat plate 111 is also pulled downward in direction D. Heat plate 111 can thus be tightened against upper surface 124 of worktop 120 and substructure unit 101 can be fixed in place. In this embodiment heat plate 111 will not need to make contact with bush 106, but does however cover it. Flame distributor 140, burner cover 141 and the pan support are subsequently placed from above.

Heat plate 111 has a downward flanged edge 114 for causing the horizontal upper surface of heat plate 111 to extend about 1 cm above upper surface 124, this being favourable for the purpose of keeping heat away from the worktop, and for holding a U-shaped sealing profile 115 with which a seal is realized against upper surface 124. Flanged edge 114 moreover forms a placing aid for the pan support 142/146 when the inner diameter thereof corresponds to the outer diameter of heat plate 111.

In the shown embodiment (FIG. 1A1) four gas rings 12 (FIG. 2) are positioned on worktop 4. Control knobs 14 are positioned in the shown embodiment in twos in the corners of worktop 4. In the shown embodiment both gas rings 20 at the sides of worktop 5 are of a 5 kW type, while the two other gas rings 12 are of respectively 3 and 2 kW type. In the shown embodiment worktop 4 has dimensions of about 503 mm wide and 853 mm long.

Provided on the underside of cooker system 2 (FIG. 3) is a copper gas pipe 28 with a diameter of 15 mm and a wall thickness of 1 mm. Gas pipe 28 forms the inlet for cooker system 2 and carries the supplied gas to gas valves 30. Gas ring 12 is supplied from gas valves 30 using aluminium pipe 32 with a diameter of 8 mm and a wall thickness of 1 mm. The two largest gas rings 12 of the 5 kW type are additionally provided with a copper feed with a diameter of 4 mm and a wall thickness of 1 mm. Gas rings 12 are also each individually provided with ignition mechanisms 36. Gas valve 30 can be controlled using control knob 14.

Figure 4:
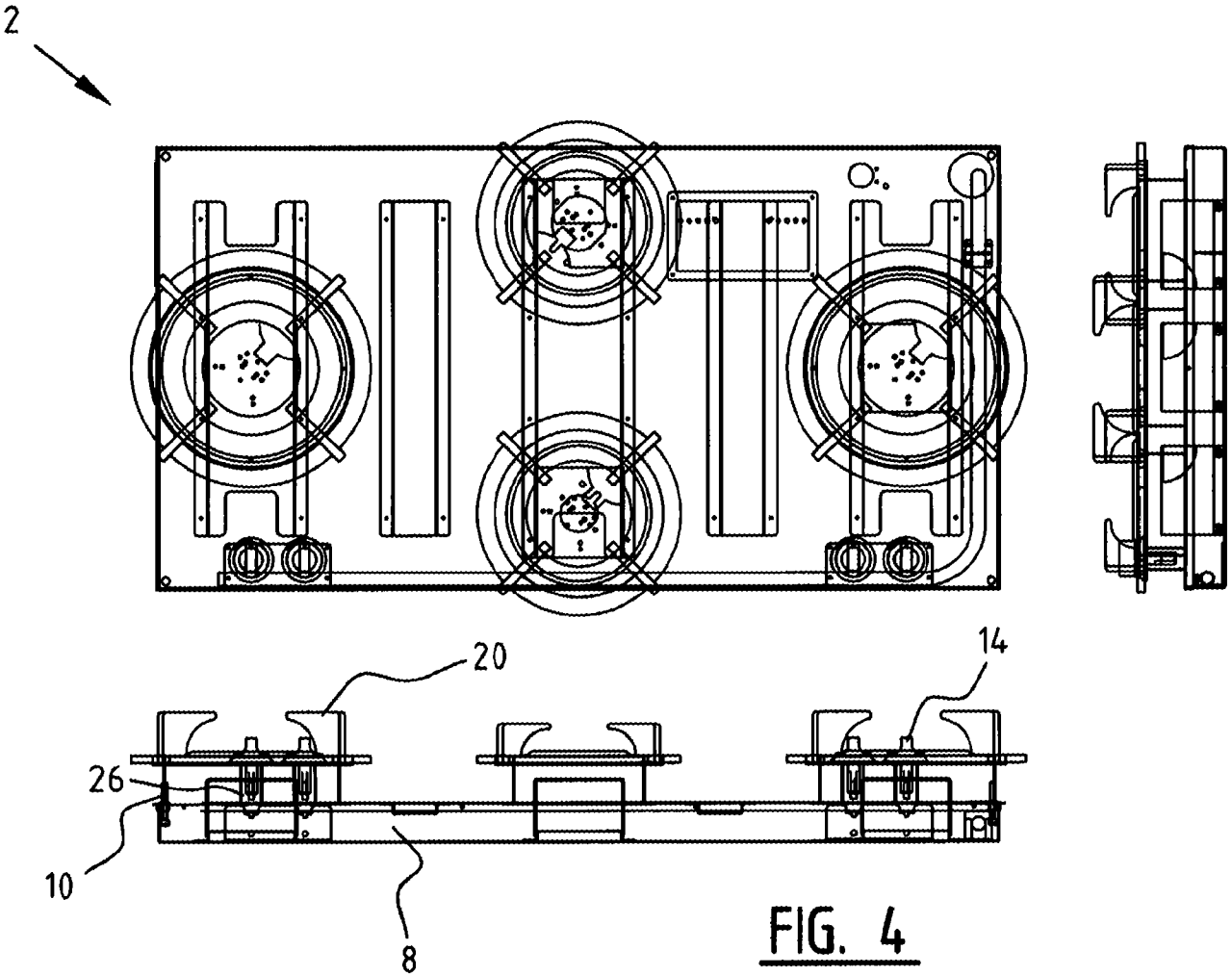
FIG. 4 shows views of the burner module of FIG. 1.

The height of the whole burner module 6 is about 8 mm in the shown embodiment. Rotary knobs or control knobs 14 are connected using a connecting tube 26 to carrier 8 (shown in FIG. 4 without worktop 4). The thickness of carrier 8 is about 95 mm in the shown embodiment.

Figure 5B:
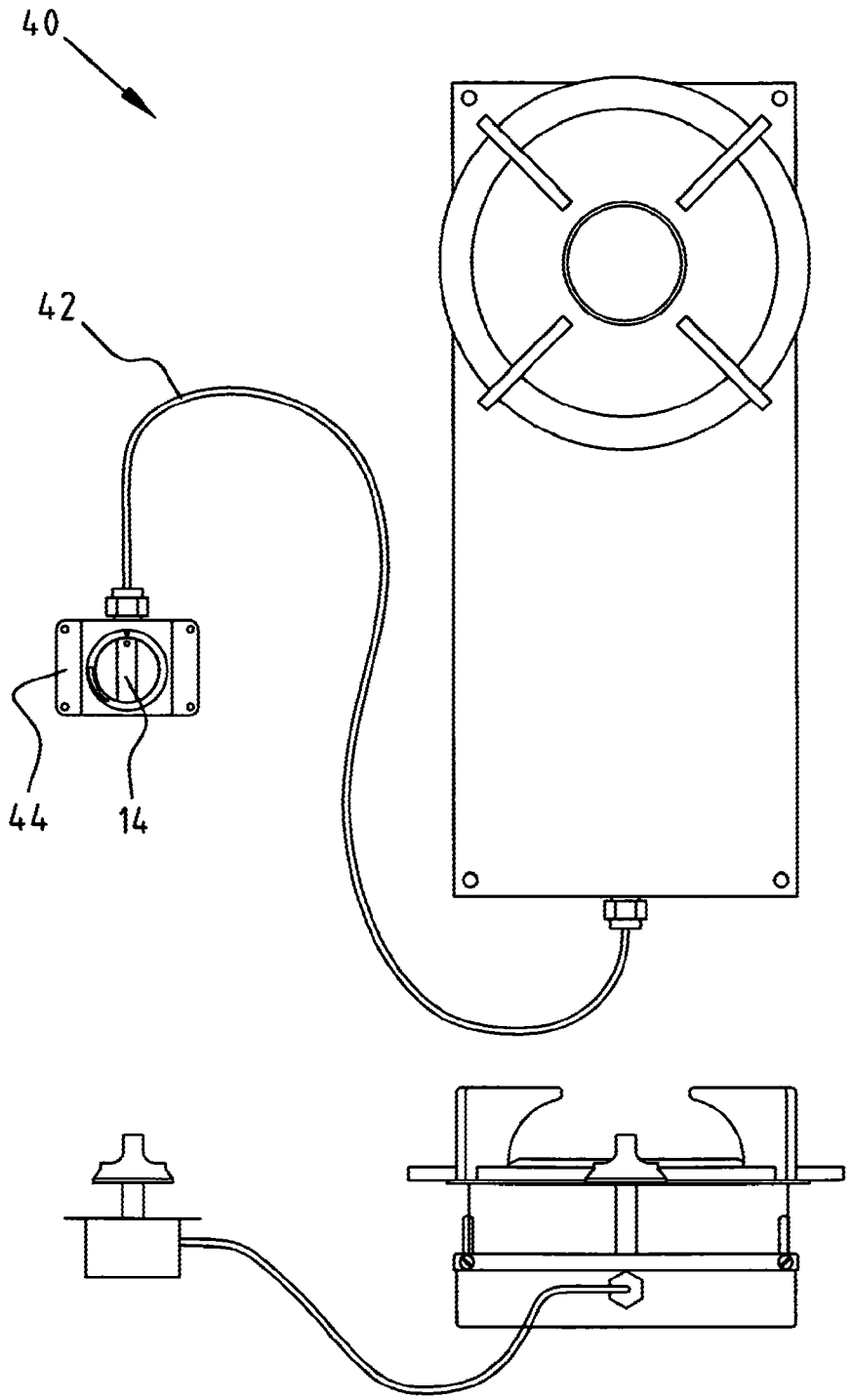

A cooker system 2 can be embodied as a configuration 38 with a fixed position for control knob 14 (FIG. 5A) and as a configuration 40 wherein control knob 14 is provided in a control box 44 operatively connected to gas valves 30 by means of a flexible control cable 42 (FIG. 5B). Using configuration 40 the control can be placed freely on a worktop 4. The width of configurations 38, 40 amount in the shown embodiment to about 275 mm and the length to for instance about 389 mm.

A pan support 46 (FIG. 6) is provided with an outer ring 48 and, in the shown embodiment, four legs or supports 50. In the shown embodiment outer ring 48 has an outer diameter of about 228 mm and amounts at the position of the pan support to about 44.5 mm.

An alternative pan support 52 (FIG. 7) is provided with an outer ring 54 with four supports 56. Outer edge 54 is provided with an increasing thickness as seen from the centre of ring 54. In the shown embodiment the thickness increases from 6 mm to 12 mm.

Burner module 6 can be provided in modular manner such that diverse configurations can be obtained for cooker systems 2 (FIG. 8). Diverse configurations can for instance thus be assembled, making use of different types of burner such as for instance the 2, 3 and 5 kW types. The number of gas rings 12 can likewise be varied here from for instance one to five. Shown configurations 58, 60, 62, 64, 66, 68, 70, 72, 74, 76, 78, 80, 82, 84, 86, 88 and 90 are assembled from such modular burner modules 6. Other configurations are of course also possible.

Control knob 14 (FIG. 9) is placed in a sealing ring 16 which in the shown embodiment is connected with double-sided tape 18 to worktop 4. Control knob 14 is connected via tube 26 to burner module 6. Sealing ring 16 serves here as guide and positioning for control knob 14.

In an alternative embodiment cooker system 92 (FIG. 10) is provided with rectangular gas rings 94. The other parts are preferably the same here as shown for cooker system 2. The overall width of system 92 amounts to about 853 mm and the depth to 503 mm. The overall thickness including worktop and including substructure amounts to about 88 mm from the upper side of the worktop.

A burner module 6 is assembled in a controlled environment. If desired at a user location, or alternatively also in a controlled environment such as in a factory, burner module 6 is preferably attached to the underside of worktop 4 using a number of adjusting screws 10. Control knobs 14, cover plates 22 and pan supports 20 are then arranged from the upper side of worktop 4. Prior to placing of burner module 6 on worktop 4 recesses are provided on worktop 4 at the positions desired by the user. After placing of the burner module as a unit on worktop 4 the gas connection is connected to the inlet, after which cooker system 2 is ready for use.

The assembly of the burner module and cooker is elucidated below in more detail on the basis of a number of steps to be followed.

- Check whether the number of control knobs and sealing dishes therefor, as well as the number of heat shields (or heat plates or dishes) is the same as the number of burners;
- Unscrew the heat shields from the module or unit;
- Check whether the number of silicone sealing rings or spacers is the same as the number of burners;
- Press the sealing ring carefully over the edge of the heat shield, particularly pressing the final part with both thumbs over the edge, and check whether the ring fits properly as a whole;
- Screw the adjusting screws 10,11 at positions 206 back to about 3 mm above the unit;
- Place the heat conductor on the unit and check the position;
- Position the unit carefully under the worktop;
- Place the unit as a whole through the pattern of holes to a position closely against the underside of the worktop and, if necessary, support temporarily;
- Place the heat shields over the burners, wherein care is taken with possible recesses and with the electrical spark ignition 200 which is susceptible to breakage;
- Tighten the heat shields by hand at the position where heat shields and shaft 204 of the burner lie in line with fixation pin 202 so that no blockage is created and the burner operates properly;
- Check whether the sealing ring is fixed flat against the top and does not protrude outside the heat shield;
- Place all burner components at the associated burner housings;
- Place the flame distributor(s) on the gas housing and assemble the burner;
- Place the outer ring and the inner ring and take care with the stabilizing fixation pin 202 during placing of the pan support, wherein pin 202 positions the pan support correctly so that the burner functions properly;
- Connect the gas hose and place the plug in an earthed wall socket and tighten at adjustment positions by hand so that the heat conductor moves (upward) into position;
- Tighten screws 11 for the heat-conductive plate by hand at adjustment positions 206 in the centre and then tighten screws 10 by hand at uppermost positions 206 in FIG. 2;
- Place the adjusting spanner 208 straight on stop of gas valve, wherein the two measurement points are only a few millimetres directly above the top as a kind of depth gauge;
- Ensure that adjusting spanner 208 is placed against the flat side of the gas valve and that the underside of the adjustment spanner comes directly against the stop;
- Tighten screws 10 at lowest adjustment positions 206 in FIG. 2 until spanner 208 makes contact with the worktop, and take care that the measurement points make contact simultaneously with the worktop;
- Place the sealing dish and control knob loosely on the worktop, wherein these are adhered fixedly only after testing and wherein the gas valve is as it were lengthened by the control knob;
- Open the control knob and release upon ignition and, if the burner goes out upon release, this is usually because the lowest positions 206 in FIG. 2 have been screwed too tightly;
- Ensure that the indicator of the control knob corresponds to the indicator of the sealing dish;
- Remove the adhesive strip of the sealing dish;
- Position the control knob with the sealing dish on the worktop and press the knob firmly with sealing dish onto the worktop.

The present invention is by no means limited to the above described preferred embodiments thereof. The rights sought are defined by the following claims, within the scope of which many modifications can be envisaged. Although the invention is specifically advantageous when used for the purpose of gas burners, other applications are also possible, such as electrical or combinations thereof with gas.

The invention claimed is:

1. A cooker system comprising:

a freestanding worktop;

a cooker burner module, wherein the cooker burner module includes a carrier having a plurality of gas burners coupled to a surface of the carrier, wherein each of the gas burners are installed from below the worktop and has a portion extending above a top of the carrier, wherein the carrier further includes adjusting screws positioned between the gas burners, and wherein the carrier is coupled to an underside of the worktop by the adjusting screws which have at least one end thereof in direct contact with the underside of the worktop;

a heat-conductive element between the top of the carrier and coupled directly to the underside of the worktop, wherein the heat-conductive element is disposed over an entire length of the carrier that includes continuous span across the plurality of gas burners, wherein the heat-conductive element provides additional support to the worktop, reduces point loads from fastening elements, and improves heat discharge from the worktop, and wherein the adjusting screws press the heat-conductive element against the underside of the worktop;

an inlet provided on the carrier for supplying gas; and supply means provided between the inlet and the gas burners.

2. The cooker system of claim 1, wherein the carrier comprises additional adjusting screws positioned at ends of the carrier and connecting the carrier to the worktop.

3. The cooker system of claim 2, wherein the worktop has a thickness in a range of 1 to 50 mm.

4. The cooker system of claim 1, further comprising a control knob mounted on the worktop and configured to control a valve coupled to the supply means, and wherein a sealing ring is provided for sealing and/or positioning the control knob relative to the worktop.

5. The cooker system of claim 1, further comprising a lengthening means operatively connected to the supply means.

6. The cooker system of claim 1, further comprising a flexible control cable operatively connecting an operating means to a valve operatively connected to the supply means.

7. The cooker system of claim 2, further comprising a cover plate positioned on one of the gas burners on an upper surface of the worktop, and wherein the cover plate has a reverse U-shape.

8. The cooker system of claim 7, wherein the cover plate extends in a radially outward direction over the upper surface of the worktop, wherein the cover plate is fixed to the one of the gas burners, and wherein the additional adjusting screws engage the underside of the worktop and tighten the cover plate against the upper surface of the worktop.

9. The cooker system of claim 7, wherein the cover plate comprises spacer means with which the cover plate can be provided at a distance from the worktop.

10. The cooker system of claim 9, wherein the spacer is formed by a ring.

11. The cooker system of claim 1, further comprising a pan support comprising of a plurality of supports disposed on an outer ring, wherein the outer ring comprises an increasing thickness from a center of the outer ring toward the periphery.

12. The cooker system of claim 1, wherein the worktop comprises a plurality of through-holes, wherein each of the gas burners extends into a corresponding one of the through-holes, and wherein each of the gas burners is enclosed by a heat plate on a top of the worktop.

13. The cooker system of claim 12, wherein each of the gas burners is surrounded by a bush, each of the bushes extends from the top of the carrier, the heat plates form parts of housings for the gas burners, and wherein other portions of the housings are formed by the bushes.

14. The cooker system of claim 12, wherein the heat plates form a support for burner body parts/flame distributors releasable therefrom without tools.

15. A kitchen provided with the cooker system as claimed in claim 12.

16. The cooker system of claim 1, wherein the heat-conductive element is one of a plate, a mesh or a grid.

17. The cooker system of claim 1, wherein the heat-conductive element is a plate-like element.

18. The cooker system of claim 1, wherein each of the gas burners is surrounded by a bush, and wherein each of the bushes extends from the top of the carrier.

19. Method for manufacturing a cooker system, comprising the steps of:

providing a freestanding worktop;

providing a plurality of recesses in the worktop;

placing a heat-conductive element over a top side of a carrier of a cooker burner module, wherein the cooker burner module includes a plurality of gas burners coupled to a surface of the carrier, wherein portions of each of the gas burners extend above a top of the carrier, wherein the heat-conductive element is disposed over an entire length of the carrier that includes a continuous span across the plurality of gas burners, wherein the carrier includes an inlet for supplying gas and pipes provided between the inlet and the gas burners, and wherein the carrier further comprises adjusting screws positioned between the gas burners and adjusting screws located at ends of the carrier;

after placing the heat-conductive element over the top side of the carrier, installing the cooker burner module on an underside of the worktop so that the heat-conductive element is disposed directly against the underside of the worktop, the carrier is under the heat-conductive element, and each of the gas burners is located in a corresponding one of the recesses; and tightening the adjusting screws positioned between the gas burners and the adjusting screws located at ends of the carrier, wherein the adjusting screws positioned between the gas burners have at least one end thereof in direct contact with the underside of the worktop and press the heat-conductive element against the underside of the worktop.

20. Method as claimed in 19, wherein a dish is placed from above onto the worktop and fixed to the carrier, and is tightened downward relative to an upper surface of the carrier.

21. The method of claim 19, wherein the heat-conductive element is one of a plate, a mesh or a grid.

22. The method of claim 19, wherein each of the gas burners is surrounded by a bush, and wherein each of the bushes extends from the top of the carrier.

* * * * *